US007108641B2

(12) United States Patent
Pertegaz-Esteban

(10) Patent No.: US 7,108,641 B2
(45) Date of Patent: Sep. 19, 2006

(54) EXERCISE EQUIPMENT WITH MULTI-POSITIONING HANDLES

(75) Inventor: Victor Pertegaz-Esteban, Valencia (ES)

(73) Assignee: Nautilus, Inc., Vancouver, WA (US)

( * ) Notice: Subject to any disclaimer, the term of this patent is extended or adjusted under 35 U.S.C. 154(b) by 134 days.

(21) Appl. No.: 09/848,112

(22) Filed: May 2, 2001

(65) Prior Publication Data

US 2002/0035017 A1 Mar. 21, 2002

Related U.S. Application Data

(60) Provisional application No. 60/201,621, filed on May 3, 2000.

(51) Int. Cl.
*A63B 21/00* (2006.01)

(52) U.S. Cl. ..... 482/139; 482/92; 482/100; 482/137

(58) Field of Classification Search ..... 482/24, 482/44, 45, 62, 97–100, 106, 108, 109, 136, 482/141, 148, 905, 908, 46, 49, 50, 135, 482/138, 72, 137, 139; 16/408, 409, 110.1, 16/900, DIG. 12; D21/662, 694, 673–677; 601/33; 403/57, 58

See application file for complete search history.

(56) References Cited

U.S. PATENT DOCUMENTS

| | | | | |
|---|---|---|---|---|
| 37,713 | A | 2/1863 | Van Houten | |
| 43,149 | A | 6/1864 | Wood | |
| 108,401 | A * | 10/1870 | Smith | 482/97 |
| 192,338 | A | 6/1877 | Marshall | |
| 393,265 | A | 11/1888 | Rice | |
| 457,400 | A | 8/1891 | Dowd | |
| 511,251 | A | 12/1893 | Pickles | |
| 551,803 | A | 12/1895 | Whitely | |
| 580,420 | A | 4/1897 | Nickerson | |
| 595,492 | A | 12/1897 | McFadden | |
| 629,655 | A | 7/1899 | Bryon, Jr. | |
| 664,210 | A | 12/1900 | Bryon, Jr. | |
| 684,688 | A | 10/1901 | Herz | |
| 685,788 | A | 11/1901 | McFadden | |
| 691,538 | A | 1/1902 | Frigerio | |
| 716,520 | A | 12/1902 | Cole | |
| 763,475 | A | 6/1904 | Frazee et al. | |
| 772,906 | A | 10/1904 | Reach | |
| 776,824 | A | 12/1904 | Byron, Jr. | |
| 799,270 | A * | 9/1905 | Roland | 482/97 |
| 848,272 | A | 3/1907 | Thornley | |
| 885,074 | A | 4/1908 | Nidever | |
| 1,053,109 | A | 2/1913 | Reach | |
| 1,205,426 | A | 11/1916 | Barnhill | |

(Continued)

FOREIGN PATENT DOCUMENTS

| | | |
|---|---|---|
| CA | 1 183 882 | 3/1985 |

(Continued)

OTHER PUBLICATIONS

Nebula Fitness Equipment by Proto Weld, Inc., 4005—Lever Row Swivel Adjustments, Brochure received in PTO Sep. 1995.*

(Continued)

*Primary Examiner*—Jerome W. Donnelly
*Assistant Examiner*—Victor K. Hwang
(74) *Attorney, Agent, or Firm*—Dorsey & Whitney LLP

(57) ABSTRACT

A handle for an exercise device, the handle attached to an actuating arm of the exercise device and including a connection structure that allows the handle to rotate with respect to the arm, as well as pivot in at least two directions orthogonal to the rotation axis.

12 Claims, 10 Drawing Sheets

U.S. PATENT DOCUMENTS

| | | | | |
|---|---|---|---|---|
| 1,371,750 | A * | 3/1921 | Fox | 464/134 |
| 1,547,268 | A | 7/1925 | Sotomayor | |
| 1,585,748 | A | 5/1926 | Wendelken | |
| 1,646,818 | A | 10/1927 | Holland | |
| 1,703,104 | A | 2/1929 | Hassler | |
| 1,707,791 | A | 4/1929 | Anderson | |
| 1,745,435 | A | 2/1930 | Mensendieck | |
| 1,867,642 | A | 7/1932 | Woods | |
| 1,928,089 | A | 9/1933 | Blickman | |
| 2,131,570 | A | 9/1938 | Riley | |
| 2,223,309 | A | 11/1940 | Swanson | |
| 2,436,987 | A | 3/1948 | Bailleaux | |
| 2,632,645 | A | 3/1953 | Barkschat | |
| 2,753,722 | A | 7/1956 | De Grave | |
| 2,788,211 | A | 4/1957 | Ivanoff | |
| 2,855,199 | A | 10/1958 | Noland et al. | |
| 2,921,791 | A * | 1/1960 | Berne | 482/118 |
| 2,944,592 | A | 7/1960 | Halter | |
| 2,977,120 | A | 3/1961 | Morris | |
| 3,306,611 | A | 2/1967 | Gaul | |
| 3,309,084 | A | 3/1967 | Simmons | |
| 3,323,366 | A | 6/1967 | DeLorme, Jr. et al. | |
| 3,342,485 | A | 9/1967 | Gaul | |
| 3,379,439 | A | 4/1968 | Sorenson et al. | |
| 3,394,934 | A | 7/1968 | Elia et al. | |
| 3,550,523 | A | 12/1970 | Segal | |
| 3,567,219 | A | 3/1971 | Foster | |
| 3,575,058 | A | 4/1971 | Kraus | |
| 3,588,101 | A | 6/1971 | Jungreis | |
| 3,589,715 | A | 6/1971 | Mark et al. | |
| 3,596,907 | A | 8/1971 | Brighton et al. | |
| 3,598,404 | A | 8/1971 | Bowman | |
| 3,614,097 | A | 10/1971 | Blickman | |
| 3,638,941 | A | 2/1972 | Kulkens | |
| 3,647,209 | A | 3/1972 | La Lanne | |
| 3,658,327 | A | 4/1972 | Thiede | |
| 3,662,602 | A | 5/1972 | Weiss | |
| 3,701,529 | A | 10/1972 | Kruthaupt | |
| 3,707,285 | A | 12/1972 | Martin | |
| 3,708,167 | A | 1/1973 | Potgieter | |
| 3,712,613 | A | 1/1973 | Feather et al. | |
| 3,734,495 | A | 5/1973 | Nist et al. | |
| 3,752,473 | A | 8/1973 | La Lanne | |
| 3,759,512 | A | 9/1973 | Yount et al. | |
| 3,792,860 | A | 2/1974 | Selnes | |
| 3,822,599 | A | 7/1974 | Brentham | |
| 3,848,467 | A | 11/1974 | Flavell | |
| 3,850,431 | A | 11/1974 | Winans | |
| 3,856,297 | A | 12/1974 | Schnell | |
| 3,858,873 | A | 1/1975 | Jones | |
| 3,912,261 | A | 10/1975 | Lambert, Sr. | |
| 3,970,302 | A | 7/1976 | McFee | |
| 3,981,500 | A | 9/1976 | Ryan | |
| 3,998,454 | A | 12/1976 | Jones | |
| 4,063,727 | A | 12/1977 | Hall | |
| 4,066,259 | A | 1/1978 | Brentham | |
| 4,082,267 | A | 4/1978 | Flavell | |
| 4,109,907 | A | 8/1978 | Zito | |
| 4,111,414 | A | 9/1978 | Roberts | |
| 4,114,610 | A | 9/1978 | Koch | |
| 4,129,297 | A | 12/1978 | Dolan | |
| 4,130,014 | A | 12/1978 | Eddens | |
| 4,140,312 | A | 2/1979 | Buchmann | |
| 4,149,713 | A | 4/1979 | McLeod | |
| 4,154,441 | A | 5/1979 | Gajda | |
| 4,169,591 | A | 10/1979 | Douglas | |
| 4,199,139 | A | 4/1980 | Mahnke et al. | |
| 4,200,279 | A | 4/1980 | Lambert, Jr. | |
| 4,204,676 | A | 5/1980 | Givens | |
| 4,208,049 | A | 6/1980 | Wilson | |
| D256,821 | S | 9/1980 | Weider | |
| 4,229,002 | A | 10/1980 | Masters | |
| 4,231,568 | A | 11/1980 | Riley et al. | |
| 4,235,437 | A | 11/1980 | Ruis et al. | |
| 4,240,626 | A | 12/1980 | Lambert, Jr. | |
| 4,240,627 | A | 12/1980 | Brentham | |
| 4,247,098 | A | 1/1981 | Brentham | |
| 4,253,662 | A | 3/1981 | Podolak | |
| 4,254,949 | A | 3/1981 | Brentham | |
| 4,257,592 | A | 3/1981 | Jones | |
| 4,272,074 | A | 6/1981 | Sferle | |
| 4,290,597 | A | 9/1981 | Schleffendorf | |
| 4,296,924 | A | 10/1981 | Anzaldua et al. | |
| D262,812 | S | 1/1982 | Lambert, Jr. et al. | |
| 4,328,965 | A | 5/1982 | Hatfield | |
| 4,333,644 | A | 6/1982 | Lambert, Jr. et al. | |
| 4,336,934 | A | 6/1982 | Hanagan et al. | |
| 4,349,192 | A | 9/1982 | Lambert, Jr. et al. | |
| 4,349,193 | A | 9/1982 | Lambert, Jr. et al. | |
| 4,354,675 | A | 10/1982 | Barclay et al. | |
| 4,354,676 | A | 10/1982 | Ariel | |
| 4,357,010 | A | 11/1982 | Telle | |
| 4,357,011 | A | 11/1982 | Voris | |
| RE31,113 | E | 12/1982 | Coker et al. | |
| 4,363,480 | A | 12/1982 | Fisher et al. | |
| RE31,170 | E | 3/1983 | Mazman | |
| 4,387,893 | A | 6/1983 | Baldwin | |
| 4,387,894 | A | 6/1983 | Baumann | |
| 4,397,462 | A | 8/1983 | Wilmarth | |
| 4,398,713 | A | 8/1983 | Ellis | |
| 4,402,505 | A | 9/1983 | Young | |
| 4,405,128 | A | 9/1983 | Mclaughlin et al. | |
| 4,407,503 | A | 10/1983 | Nishizawa | |
| 4,411,421 | A | 10/1983 | Hershberger | |
| 4,411,424 | A | 10/1983 | Barnett | |
| 4,426,077 | A | 1/1984 | Becker | |
| 4,428,578 | A | 1/1984 | Kirkpatrick | |
| 4,429,871 | A | 2/1984 | Flechner | |
| 4,456,245 | A | 6/1984 | Baldwin | |
| 4,466,613 | A | 8/1984 | Reese | |
| 4,468,025 | A | 8/1984 | Sferle | |
| 4,469,325 | A | 9/1984 | Ware | |
| 4,478,411 | A | 10/1984 | Baldwin | |
| 4,478,413 | A | 10/1984 | Siwula | |
| 4,493,485 | A | 1/1985 | Jones | |
| 4,494,662 | A | 1/1985 | Clymer | |
| 4,494,751 | A | 1/1985 | Schnell | |
| 4,500,089 | A | 2/1985 | Jones | |
| 4,502,681 | A | 3/1985 | Blomqvist | |
| 4,505,475 | A | 3/1985 | Olschansky et al. | |
| 4,511,137 | A | 4/1985 | Jones | |
| 4,512,571 | A | 4/1985 | Hermelin | |
| 4,515,363 | A | 5/1985 | Schleffendorf | |
| 4,535,985 | A | 8/1985 | Mask | |
| 4,536,027 | A | 8/1985 | Brennan | |
| 4,540,171 | A | 9/1985 | Clark et al. | |
| 4,542,899 | A | 9/1985 | Hendricks | |
| 4,546,971 | A | 10/1985 | Raasoch | |
| 4,549,733 | A | 10/1985 | Salyer | |
| 4,555,109 | A | 11/1985 | Hartmann | |
| 4,563,000 | A | 1/1986 | Gall | |
| 4,568,078 | A | 2/1986 | Weiss | |
| 4,589,656 | A | 5/1986 | Baldwin | |
| D284,597 | S | 7/1986 | Smith et al. | |
| 4,598,908 | A | 7/1986 | Morgan | |
| 4,600,196 | A | 7/1986 | Jones | |
| 4,601,466 | A | 7/1986 | Lais | |
| 4,602,373 | A | 7/1986 | Dorfman | |
| 4,603,855 | A | 8/1986 | Sebelle | |
| 4,605,389 | A | 8/1986 | Westhoff | |
| 4,606,541 | A | 8/1986 | Kirkpatrick | |
| 4,609,189 | A | 9/1986 | Brasher | |
| 4,609,193 | A | 9/1986 | Paris et al. | |
| 4,620,704 | A | 11/1986 | Shifferaw | |

4,621,807 A 11/1986 Stramer
4,624,457 A 11/1986 Silberman et al.
4,627,615 A 12/1986 Nurkowski
4,629,185 A * 12/1986 Amann ..... 482/113
4,632,388 A 12/1986 Schleffendorf
4,632,390 A 12/1986 Richey
4,634,118 A 1/1987 Jensen
4,634,127 A 1/1987 Rockwell
4,635,926 A 1/1987 Minkow
4,640,508 A 2/1987 Escher
4,643,420 A 2/1987 Riley et al.
4,645,205 A 2/1987 Wolff
4,648,594 A 3/1987 Schleffendorf
4,653,750 A 3/1987 McIntyre
4,666,149 A 5/1987 Olschansky et al.
4,666,152 A 5/1987 Jones
4,684,124 A 8/1987 Escher
4,684,125 A 8/1987 Lantz
4,685,670 A 8/1987 Zinkin
4,687,197 A 8/1987 Larsson et al.
4,690,402 A 9/1987 Basting
4,697,809 A 10/1987 Rockwell
4,700,944 A 10/1987 Sterba et al.
4,703,928 A 11/1987 Escher
4,708,338 A 11/1987 Potts
4,709,918 A 12/1987 Grinblat
4,709,920 A 12/1987 Schnell
4,717,145 A 1/1988 Chininis
4,721,303 A 1/1988 Fitzpatrick
4,722,522 A 2/1988 Lundgren
4,725,056 A 2/1988 Behrl et al.
4,725,057 A 2/1988 Shifferaw
4,730,828 A 3/1988 Lane
4,730,829 A 3/1988 Carlson
4,732,381 A 3/1988 Skowronski
4,733,860 A 3/1988 Steffee
4,743,011 A 5/1988 Coffey
4,749,182 A 6/1988 Duggan
4,749,189 A 6/1988 Frank
4,750,736 A 6/1988 Watterson
4,753,126 A 6/1988 Sammaratano
4,756,527 A 7/1988 Ledbetter
4,763,897 A 8/1988 Yakata
4,765,613 A 8/1988 Voris
4,765,614 A 8/1988 Shute
4,768,779 A 9/1988 Oehman, Jr. et al.
4,772,015 A * 9/1988 Carlson et al. ..... 482/92
4,773,398 A * 9/1988 Tatom ..... 601/34
4,781,374 A 11/1988 Lederman
4,793,608 A 12/1988 Mahnke et al.
D299,371 S 1/1989 Tsuyama
4,795,149 A 1/1989 Pearson
4,796,881 A 1/1989 Watterson
4,799,671 A 1/1989 Hoggan et al.
4,804,179 A 2/1989 Murphy et al.
4,809,972 A 3/1989 Rasmussen et al.
4,809,973 A 3/1989 Johns
4,813,667 A 3/1989 Watterson
4,815,746 A 3/1989 Ward, Jr.
4,822,032 A 4/1989 Whitmore et al.
4,822,036 A 4/1989 Dang
4,824,104 A 4/1989 Bloch
4,826,153 A 5/1989 Schalip
4,826,157 A 5/1989 Fitzpatrick
4,834,365 A 5/1989 Jones
4,834,367 A 5/1989 Salyer et al.
4,836,536 A 6/1989 Jones
4,836,537 A 6/1989 Moreno
4,838,548 A 6/1989 Maag
4,840,373 A 6/1989 Maag
4,842,268 A 6/1989 Jenkins
4,842,271 A 6/1989 Vinciguerra
4,842,272 A * 6/1989 Jennings ..... 482/119
4,844,456 A 7/1989 Habing et al.
4,846,458 A 7/1989 Potts
4,848,740 A 7/1989 VanDerHoeven
4,848,741 A 7/1989 Hermanson
4,858,915 A 8/1989 Szabo
4,858,917 A 8/1989 Montgomery
4,861,025 A 8/1989 Rockwell
4,863,161 A 9/1989 Telle
4,863,163 A 9/1989 Wehrell
4,869,497 A 9/1989 Stewart et al.
4,872,668 A * 10/1989 McGillis et al. ..... 482/113
4,872,670 A 10/1989 Nichols
4,878,397 A 11/1989 Lennon
4,878,662 A 11/1989 Chern
4,878,663 A 11/1989 Luquette
4,883,270 A 11/1989 Maag
4,889,336 A 12/1989 Schneiderman
4,890,830 A 1/1990 Kern
D306,050 S 2/1990 Brentham
4,898,381 A 2/1990 Gordon
4,900,018 A 2/1990 Ish, III et al.
4,902,007 A 2/1990 Ferrari
4,902,009 A 2/1990 Jones
4,907,798 A 3/1990 Burchatz
4,911,435 A 3/1990 Johns
4,911,438 A 3/1990 Van Straaten
4,913,423 A 4/1990 Farran et al.
D307,782 S 5/1990 Birrell et al.
4,921,242 A 5/1990 Watterson
4,930,768 A 6/1990 Lapcevic
4,940,227 A 7/1990 Coffey
4,944,511 A 7/1990 Francis
4,949,951 A 8/1990 Deola
4,961,428 A 10/1990 Nikias et al.
4,974,838 A 12/1990 Sollenberger
4,979,737 A 12/1990 Kock
4,982,955 A 1/1991 Heasley
4,986,538 A 1/1991 Ish, III
4,988,095 A 1/1991 Ferrari
4,993,666 A 2/1991 Baymak et al.
5,000,446 A 3/1991 Sarno
5,002,271 A 3/1991 Gonzales
5,005,831 A 4/1991 Hara
5,011,139 A 4/1991 Towley
D317,032 S * 5/1991 Eckler ..... D21/694
5,013,031 A 5/1991 Bull
5,018,725 A 5/1991 Cook
5,020,794 A 6/1991 Englehardt et al.
D317,959 S 7/1991 Francis
5,029,850 A 7/1991 van Straaten
5,037,089 A 8/1991 Spagnuolo et al.
5,039,089 A 8/1991 Lapcevic
5,039,091 A * 8/1991 Johnson ..... 482/64
5,042,798 A 8/1991 Sawicky
5,042,799 A 8/1991 Stanley
5,042,801 A 8/1991 Sterba et al.
5,044,629 A 9/1991 Ryan et al.
5,044,631 A 9/1991 Jones
5,044,632 A 9/1991 Jones
5,050,873 A 9/1991 Jones
D321,025 S 10/1991 Jones
D321,026 S 10/1991 Jones
D321,027 S 10/1991 Jones
D321,028 S 10/1991 Jones
5,056,779 A 10/1991 Webb
5,060,938 A 10/1991 Hawley, Jr.
5,060,939 A 10/1991 Oswald et al.
D321,387 S 11/1991 Jones
D321,389 S 11/1991 Jones
D321,390 S 11/1991 Jones
D321,391 S 11/1991 Jones
5,062,632 A 11/1991 Dalebout et al.
5,062,633 A 11/1991 Engel et al.

5,064,191 A 11/1991 Johnson
5,066,003 A 11/1991 Jones
5,066,004 A 11/1991 Jones
5,069,447 A 12/1991 Snyderman et al.
5,076,576 A 12/1991 Johnston
5,076,577 A 12/1991 Houston
5,076,578 A 12/1991 Askonen
5,076,579 A 12/1991 Rickey
5,080,349 A 1/1992 Vittone
5,080,351 A 1/1992 Rockwell
5,085,430 A 2/1992 Habing
5,089,960 A 2/1992 Sweeney, Jr.
5,090,694 A 2/1992 Pauls et al.
D324,710 S 3/1992 Habing
5,094,124 A 3/1992 Stonehouse
5,094,449 A 3/1992 Stearns
5,094,450 A 3/1992 Stearns
5,100,131 A 3/1992 Fong
5,102,121 A 4/1992 Solow
5,102,122 A 4/1992 Piane, Jr. et al.
5,104,121 A 4/1992 Webb
5,106,080 A 4/1992 Jones
5,106,081 A 4/1992 Webb
5,106,083 A 4/1992 Hall
5,108,095 A 4/1992 Nichols
5,116,297 A 5/1992 Stonecipher
5,120,289 A 6/1992 Yu
5,122,106 A 6/1992 Atwood et al.
5,123,886 A 6/1992 Cook
5,125,881 A 6/1992 Jones
5,125,882 A 6/1992 La Mothe et al.
D328,320 S 7/1992 Hliang
5,135,216 A 8/1992 Bingham et al.
5,135,449 A 8/1992 Jones
5,135,453 A 8/1992 Sollenberger
5,135,456 A 8/1992 Jones
5,135,458 A 8/1992 Huang
5,135,459 A 8/1992 Perry, Jr.
5,139,469 A 8/1992 Hennessey et al.
5,145,479 A * 9/1992 Olschansky et al. ..... 482/62
5,147,259 A 9/1992 Hutchins
5,147,265 A 9/1992 Pauls et al.
5,171,198 A 12/1992 Jones
5,180,354 A 1/1993 Jones
5,181,896 A 1/1993 Jones
D334,042 S 3/1993 Wang
5,190,513 A 3/1993 Habing et al.
5,195,937 A 3/1993 Engel et al.
RE34,212 E 4/1993 Potts
5,199,935 A 4/1993 Gibson et al.
5,203,755 A 4/1993 Kaiser
5,205,802 A 4/1993 Swisher
5,205,804 A 4/1993 Hall
D335,511 S 5/1993 Engel et al.
5,209,461 A 5/1993 Whightsil, Sr.
5,211,614 A 5/1993 Henes
D336,498 S 6/1993 Engel et al.
5,217,422 A 6/1993 Domzalski
5,217,487 A 6/1993 Engel et al.
5,221,244 A 6/1993 Doss
5,221,245 A 6/1993 Yeh
D337,361 S 7/1993 Engel et al.
D337,666 S 7/1993 Peterson et al.
5,226,867 A 7/1993 Beal
5,230,680 A 7/1993 Wu
5,236,406 A 8/1993 Webber
5,242,344 A * 9/1993 Hundley ..... 482/93
5,242,347 A 9/1993 Keeton
5,244,444 A 9/1993 Wostry
5,244,446 A 9/1993 Engel et al.
5,256,126 A 10/1993 Grotstein
D341,176 S 11/1993 Habing et al.
5,263,914 A 11/1993 Simonson et al.
5,263,915 A 11/1993 Habing
5,265,589 A 11/1993 Wang
5,267,930 A 12/1993 Henes
5,273,504 A 12/1993 Jones
5,273,505 A 12/1993 Jones
5,273,509 A * 12/1993 Vittone ..... 482/139
5,277,681 A 1/1994 Holt
5,282,776 A 2/1994 Dalebout
RE34,572 E 3/1994 Johnson et al.
5,290,214 A 3/1994 Chen
5,295,931 A 3/1994 Dreibelbis et al.
RE34,577 E 4/1994 Habing et al.
5,299,992 A 4/1994 Wilkinson
5,300,003 A 4/1994 Hull
5,302,161 A 4/1994 Loubert et al.
5,304,107 A 4/1994 Jones
5,306,221 A 4/1994 Itaru
D347,040 S 5/1994 Wang
D347,251 S 5/1994 Dreibelbis et al.
5,308,303 A 5/1994 Rawls et al.
5,308,304 A 5/1994 Habing
5,310,392 A 5/1994 Lo
5,312,313 A 5/1994 Holmes et al.
5,312,315 A 5/1994 Mortensen et al.
5,316,528 A 5/1994 Ziparo
5,316,534 A 5/1994 Dalebout et al.
5,320,592 A 6/1994 Olschansky et al.
5,322,489 A 6/1994 Webb et al.
5,324,246 A 6/1994 Wang
5,324,247 A 6/1994 Lepley
5,328,428 A 7/1994 Huang
5,330,405 A 7/1994 Habing et al.
5,330,408 A 7/1994 Westmoreland, Jr.
5,334,113 A * 8/1994 Roepke ..... 482/106
5,336,140 A 8/1994 LeBlond
5,336,148 A 8/1994 Ish, III
5,342,270 A 8/1994 Jones
5,344,374 A * 9/1994 Telle ..... 482/97
5,346,447 A 9/1994 Stearns
5,348,524 A 9/1994 Grant
5,354,248 A 10/1994 Rawls et al.
5,354,252 A 10/1994 Habing
5,356,360 A 10/1994 Johns
5,362,290 A 11/1994 Huang
5,366,426 A 11/1994 Glavin
5,366,432 A 11/1994 Habing et al.
D353,423 S 12/1994 Chen
5,374,229 A 12/1994 Sencil
5,378,216 A 1/1995 Ish, III et al.
5,380,258 A 1/1995 Hawley, Jr.
5,382,212 A 1/1995 Davenport et al.
D355,684 S 2/1995 Rawls et al.
5,387,170 A 2/1995 Rawls et al.
5,395,295 A 3/1995 Ish, III
5,399,133 A * 3/1995 Haber et al. ..... 482/49
5,403,257 A 4/1995 Lehtonen
5,409,435 A 4/1995 Daniels
RE34,959 E 5/1995 Potts
D358,183 S 5/1995 Habing et al.
D358,625 S 5/1995 Enriquez, Jr.
5,413,546 A 5/1995 Basile
5,417,633 A * 5/1995 Habing ..... 482/97
5,417,634 A 5/1995 Habing
D359,326 S 6/1995 Deola
5,421,796 A 6/1995 Jones et al.
5,429,569 A 7/1995 Gunnari et al.
5,431,617 A 7/1995 Rattray, Jr.
5,433,680 A 7/1995 Knudsen
5,435,798 A 7/1995 Habing et al.
5,435,799 A 7/1995 Lundin
5,437,589 A 8/1995 Habing
5,441,470 A 8/1995 Chen
D362,281 S 9/1995 Warehime et al.

5,456,644 A 10/1995 Hecox et al.
5,462,507 A 10/1995 Nichols, Sr. et al.
5,466,204 A 11/1995 Nearing
5,468,202 A 11/1995 Habing
5,468,205 A 11/1995 McFall et al.
5,470,299 A 11/1995 Yeh
5,484,365 A 1/1996 Jones et al.
5,486,150 A 1/1996 Randolph
5,487,714 A 1/1996 Ferrari
5,492,386 A 2/1996 Callum
5,499,959 A 3/1996 Holmes et al.
D368,501 S 4/1996 Woodruff
5,511,740 A 4/1996 Loubert et al.
D370,040 S 5/1996 Habing et al.
5,518,477 A 5/1996 Simonson
D370,949 S 6/1996 Furner
D371,176 S 6/1996 Furner
5,527,243 A 6/1996 Chen
5,527,245 A 6/1996 Dalebout
5,533,953 A 7/1996 Lui et al.
5,540,639 A 7/1996 Potts
5,542,895 A 8/1996 Colbo, Jr.
5,549,530 A 8/1996 Fulks
5,549,533 A 8/1996 Olson et al.
5,554,084 A 9/1996 Jones
5,554,085 A 9/1996 Dalebout
5,554,086 A 9/1996 Habing et al.
5,554,089 A 9/1996 Jones
5,554,090 A 9/1996 Jones
5,562,577 A 10/1996 Nichols, Sr. et al.
5,565,002 A 10/1996 Rawls et al.
5,580,337 A 12/1996 Habing et al.
5,580,340 A 12/1996 Yu
5,580,341 A 12/1996 Simonson
5,582,564 A 12/1996 Nichols, Sr. et al.
5,586,962 A 12/1996 Hallmark
5,588,942 A * 12/1996 Dillard ..... 482/139
5,591,105 A 1/1997 Dalebout et al.
5,597,257 A 1/1997 Habing
5,597,375 A 1/1997 Simonson
5,599,256 A 2/1997 Hughes, Jr.
5,601,518 A 2/1997 Weintraub
RE35,470 E 3/1997 Jones
5,616,107 A 4/1997 Simonson
5,616,110 A 4/1997 Nascimento
5,616,111 A 4/1997 Randolph
5,624,353 A 4/1997 Naidus
5,624,362 A 4/1997 Wilson
5,626,548 A 5/1997 Coyle
5,628,715 A 5/1997 Simonson
D380,024 S 6/1997 Novak et al.
5,637,059 A 6/1997 Dalebout
5,643,151 A 7/1997 Naimo
5,655,997 A 8/1997 Greenberg et al.
5,665,036 A 9/1997 Hsieh
5,667,464 A 9/1997 Simonson
5,669,861 A 9/1997 Toups
5,669,865 A 9/1997 Gordon
5,674,167 A 10/1997 Piaget et al.
5,681,079 A 10/1997 Robinson
5,692,997 A 12/1997 Stearns
5,709,633 A 1/1998 Sokol
5,713,823 A 2/1998 Walendzak et al.
5,716,308 A 2/1998 Lee
5,718,654 A 2/1998 Kennedy
5,722,921 A 3/1998 Simonson
5,722,922 A 3/1998 Watterson et al.
5,725,459 A 3/1998 Rexach
5,733,229 A 3/1998 Dalebout et al.
5,733,233 A 3/1998 Webber
5,738,616 A 4/1998 Robertson
5,755,645 A * 5/1998 Miller et al. ..... 482/115
5,762,584 A 6/1998 Daniels
5,769,757 A 6/1998 Fulks
5,769,766 A 6/1998 Huang
5,776,040 A 7/1998 Webb et al.
5,788,615 A 8/1998 Jones
5,800,321 A 9/1998 Webber
5,803,882 A 9/1998 Habing et al.
5,807,219 A 9/1998 Webber et al.
5,810,698 A 9/1998 Hullett et al.
5,810,701 A 9/1998 Ellis et al.
5,813,951 A 9/1998 Einsig
5,820,529 A 10/1998 Weintraub
5,827,157 A 10/1998 Lee
5,836,858 A 11/1998 Sharff
5,839,997 A 11/1998 Roth et al.
5,860,894 A 1/1999 Dalebout
5,876,313 A 3/1999 Krull
5,885,193 A 3/1999 Habing et al.
5,888,179 A 3/1999 Singhal
5,897,467 A * 4/1999 Habing et al. ..... 482/100
5,904,638 A 5/1999 Habing et al.
5,906,566 A 5/1999 Whitcomb
5,921,897 A 7/1999 Stevens
5,921,902 A 7/1999 Carpenter
5,931,767 A 8/1999 Morales
5,938,551 A 8/1999 Warner
5,944,641 A 8/1999 Habing
D413,948 S 9/1999 Dalebout
5,951,448 A 9/1999 Bolland
5,961,427 A 10/1999 Habing et al.
5,961,428 A 10/1999 Webber
5,964,684 A 10/1999 Sokol
5,967,954 A 10/1999 Habing
5,971,895 A 10/1999 Habing
5,989,165 A 11/1999 Giannelli et al.
5,993,356 A 11/1999 Houston et al.
6,004,247 A * 12/1999 Webber ..... 482/100
6,004,248 A 12/1999 Price
6,022,299 A 2/2000 Stewart
6,027,429 A 2/2000 Daniels
6,056,678 A 5/2000 Giannelli et al.
6,059,701 A 5/2000 George et al.
6,074,328 A 6/2000 Johnson
6,090,020 A 7/2000 Webber
D428,949 S 8/2000 Simonson
6,099,440 A 8/2000 Schurter et al.
6,117,055 A 9/2000 Boland
6,120,416 A 9/2000 Walker
6,120,421 A 9/2000 Kuo
D431,615 S 10/2000 Webber et al.
6,126,580 A 10/2000 Francis et al.
6,171,219 B1 1/2001 Simonson
6,186,927 B1 2/2001 Krull
6,206,812 B1 3/2001 Nizamuddin
6,217,493 B1 4/2001 Spletzer
6,220,993 B1 4/2001 Sencil
6,224,514 B1 5/2001 Price
6,238,323 B1 5/2001 Simonson
6,251,052 B1 6/2001 Simonson
6,257,997 B1 7/2001 Doble et al.
6,258,016 B1 7/2001 Kuo
6,261,022 B1 7/2001 Dalebout et al.
6,264,586 B1 7/2001 Webber
6,264,588 B1 7/2001 Ellis
6,287,241 B1 9/2001 Ellis
6,296,594 B1 10/2001 Simonson
6,296,596 B1 10/2001 Alessandri et al.
6,319,178 B1 11/2001 Webber
D455,803 S 4/2002 Webber
6,364,815 B1 4/2002 Lapcevic
6,371,896 B1 4/2002 Kettler
6,387,020 B1 5/2002 Simonson
6,394,937 B1 * 5/2002 Voris ..... 482/139
6,402,666 B1 6/2002 Krull

| | | | | |
|---|---|---|---|---|
| 6,409,631 | B1 | 6/2002 | Alessandri | |
| 6,422,979 | B1 | 7/2002 | Krull | |
| 6,422,980 | B1 | 7/2002 | Simonson | |
| 6,440,044 | B1 | 8/2002 | Francis et al. | |
| 6,443,877 | B1 | 9/2002 | Hoecht et al. | |
| 6,447,430 | B1 | 9/2002 | Webb et al. | |
| 6,458,061 | B1 | 10/2002 | Simonson | |
| 6,471,624 | B1 * | 10/2002 | Voris | 482/142 |
| 6,482,139 | B1 | 11/2002 | Haag | |
| 6,488,612 | B1 | 12/2002 | Sechrest et al. | |
| 6,491,609 | B1 | 12/2002 | Webber | |
| 6,491,610 | B1 | 12/2002 | Henn | |
| 6,500,106 | B1 * | 12/2002 | Fulks | 482/137 |
| 6,517,468 | B1 | 2/2003 | Lapcevic | |
| 6,551,226 | B1 | 4/2003 | Webber et al. | |
| 6,561,960 | B1 | 5/2003 | Webber | |
| 6,575,881 | B1 | 6/2003 | Lapcevic | |
| 6,579,213 | B1 * | 6/2003 | Webber et al. | 482/100 |
| 6,585,626 | B1 | 7/2003 | McBride | |
| 6,592,498 | B1 * | 7/2003 | Trainor | 482/97 |
| 6,595,905 | B1 | 7/2003 | McBride | |
| 6,605,022 | B1 | 8/2003 | Webber | |
| 6,626,805 | B1 | 9/2003 | Lightbody | |
| 6,652,426 | B1 | 11/2003 | Carter et al. | |
| 6,652,429 | B1 | 11/2003 | Bushnell | |
| 6,669,606 | B1 | 12/2003 | Krull | |
| 6,669,609 | B1 | 12/2003 | Gerschefske et al. | |
| 6,685,607 | B1 | 2/2004 | Olson | |
| 6,689,019 | B1 | 2/2004 | Ohrt et al. | |
| 6,689,023 | B1 | 2/2004 | Baumler | |
| 6,712,740 | B1 | 3/2004 | Simonson | |
| 6,743,158 | B1 | 6/2004 | Giannelli et al. | |
| 6,746,378 | B1 | 6/2004 | Morris et al. | |
| 6,746,385 | B1 | 6/2004 | Habing | |
| 6,770,015 | B1 | 8/2004 | Simonson | |
| 6,770,017 | B1 | 8/2004 | Leipheimer | |
| 6,817,968 | B1 | 11/2004 | Galbraith et al. | |
| 6,830,542 | B1 | 12/2004 | Ball et al. | |
| 6,910,994 | B1 | 6/2005 | Mitchell et al. | |
| 6,913,565 | B1 | 7/2005 | Mitchell et al. | |
| 2002/0025890 | A1 | 2/2002 | Keiser | |
| 2002/0077230 | A1 | 6/2002 | Lull et al. | |
| 2002/0198087 | A1 | 12/2002 | Mitchell et al. | |
| 2002/0198088 | A1 | 12/2002 | Vuurmans et al. | |
| 2003/0017918 | A1 | 1/2003 | Webb et al. | |
| 2003/0022767 | A1 | 1/2003 | Webber | |
| 2003/0032524 | A1 | 2/2003 | Lamar et al. | |
| 2003/0032531 | A1 | 2/2003 | Simonson | |
| 2003/0045406 | A1 | 3/2003 | Stone | |
| 2003/0078141 | A1 | 4/2003 | Webber | |
| 2003/0092540 | A1 | 5/2003 | Gillen | |
| 2003/0092541 | A1 | 5/2003 | Giannelli | |
| 2003/0092543 | A1 | 5/2003 | Giannelli | |
| 2003/0096681 | A1 | 5/2003 | Myers et al. | |
| 2003/0100413 | A1 | 5/2003 | Huang | |
| 2003/0114281 | A1 | 6/2003 | Mackert et al. | |
| 2003/0176261 | A1 | 9/2003 | Simonson et al. | |
| 2003/0232707 | A1 | 12/2003 | Dalebout et al. | |
| 2004/0002409 | A1 | 1/2004 | Webb et al. | |
| 2004/0005966 | A1 | 1/2004 | Chen | |
| 2004/0009856 | A1 | 1/2004 | Hammer | |
| 2004/0009857 | A1 | 1/2004 | Webb et al. | |
| 2004/0023760 | A1 | 2/2004 | Cockril, Jr. et al. | |
| 2004/0023762 | A1 | 2/2004 | Lull et al. | |
| 2004/0063551 | A1 | 4/2004 | Lightbody | |
| 2004/0082444 | A1 | 4/2004 | Golesh | |
| 2004/0091307 | A1 | 5/2004 | James | |
| 2004/0176223 | A1 | 9/2004 | Morris et al. | |
| 2004/0209748 | A1 | 10/2004 | Haneckow | |
| 2004/0229735 | A1 | 11/2004 | Morris et al. | |
| 2005/0049121 | A1 | 3/2005 | Dalebout et al. | |
| 2005/0049123 | A1 | 3/2005 | Dalebout et al. | |
| 2005/0124470 | A1 | 6/2005 | Schopf | |
| 2005/0143230 | A1 | 6/2005 | Dalebout et al. | |

FOREIGN PATENT DOCUMENTS

| | | | |
|---|---|---|---|
| CA | 1 184 577 | | 3/1985 |
| CA | 1 199 946 | | 1/1986 |
| CA | 1 203 822 | | 4/1986 |
| CA | 1 256 136 | | 6/1989 |
| CH | 457230 | | 5/1968 |
| DE | 605957 | | 11/1934 |
| DE | 2346105 | | 3/1975 |
| DE | 3 300 073 | | 7/1984 |
| DE | 34 09246 | A1 | 2/1986 |
| DE | G9213188.3 | | 1/1993 |
| DE | G9411573.7 | | 11/1994 |
| DE | 4320887 | C2 | 2/1997 |
| DE | 298 01 626 | U1 | 4/1998 |
| DE | 198 01 672 | A1 | 11/1998 |
| EP | 121902 | | 10/1984 |
| EP | 177017 | | 4/1986 |
| EP | 177643 | A1 | 4/1986 |
| EP | 0 379 265 | A3 | 7/1990 |
| FR | 824654 | | 2/1938 |
| FR | 1335110 | | 8/1963 |
| FR | 2612406 | A1 | 9/1988 |
| FR | 2613237 | | 10/1988 |
| FR | 2627090 | | 8/1989 |
| GB | 325435 | | 2/1930 |
| GB | 466901 | | 6/1937 |
| GB | 1 151 656 | | 5/1969 |
| GB | 2 223 686 | A | 4/1990 |
| GB | 2 232 089 | A | 12/1990 |
| IT | 604340 | | 5/1960 |
| NL | 8800024 | | 8/1989 |
| SU | 1253654 | | 8/1986 |
| SU | 1258447 | A1 | 9/1986 |
| SU | 1367987 | A1 | 1/1988 |
| SU | 1 725 744 | A3 | 4/1992 |
| SU | 1743620 | | 6/1992 |
| TW | 210014 | | 7/1993 |
| TW | 317755 | | 10/1997 |
| TW | 331154 | | 5/1998 |
| TW | 364363 | | 7/1999 |
| WO | WO 86/06644 | | 11/1986 |
| WO | WO 90/09212 | | 8/1990 |
| WO | WO 92/18202 | | 10/1992 |
| WO | WO 94/14505 | | 7/1994 |
| WO | WO 96/26765 | | 9/1996 |
| WO | WO 01/19462 | | 3/2001 |
| WO | WO 01/66195 | A2 | 9/2001 |

OTHER PUBLICATIONS

PowerLine by TuffStuff, Task Industries Inc., PL-210 Seated Row, undated brochure.*

TuffStuff, TUB-49 Upper Body Machine, brochure received in PTO Mar. 1998.*

Cybex International, Inc., Commercial Strength Systems brochure, 4535 Arm Curl, 5225 Rear Delt,5281 Arm Curl, pp. 9 and 36, Apr. 2000.*

Cybex International, Inc., Cybex Eagle Premier Strength brochure, 11080 Arm Extension, p. 8, May 2002.*

"8300s Series II Strength System," Schwinn Cycling & Fitness Inc., one page of product brochure showing 8300 Series II Strength System, 1 page (1999).

BFit® University Presents Bally "Total Fitness PowerPump the Official Barbell Workout," Training Manual (1998).

The Body Bar, "A Total Body Conditioning Bar," brochure, The Step Company (1995).

Body Masters MD 504 Pec Contractor & Rear Deltold Machine, brochure (1994).

Body Pump™, "Aerobic Market 'Pumped Up' about New Zealands' Body Pump™ Program," Press Release, Les Mills International/The STEP Company (date unknown).

Body Pump™, "Anybody and Everybody Wants to . . . Become Some Body" Brochure, A Product of The STEP Company and Developed by Les Mills Aerobics (date unknown).
Body Pump™, "Become Some Body!", Press Release, Les Mills International/The STEP Company (date unknown).
Body Pump™, Instructor Manual Version II©, Les Mills International/The STEP Company (1998).
Body Pump™, "Taking a Good Idea One STEP Further," Press Release, The Step Company/Les Mills International (date unknown).
Body Pump™, Trainer Manual Version II©, Les Mills International/The STEP Company (1998).
Body Pump Training Brochure, The STEP Company/Les Mills International (date unknown).
Bowflex advertisement flyer and order form "Special Offer in!30 days and Receive an Extra 100lbs of Power Rods FREE!", 10 pages (1992).
"Bowflex Fitness", Bowflex, Inc., catalog, 8 pages (1998).
"Cross Bow by Weider How Does the Crossbow Stack up Against the Competition", ICON Health and Fitness located at http://www.iconfitness.com/crossbow/cb_vs_bf.html, 2 pages(retrieved Oct. 22, 2002).
Cybex World, "New Products Prove Passion for Human Performance," vol. 10, issue 2 (Jul. 2000).
"HD 1800 Inner/Outer Thigh," Hoist Fitness Systems, Inc., located at http://www.hoistfitness.com, 3 pages (retrieved Apr. 30, 2004).
Introducing . . . Nautilus for Women by Dan Baldwin, National Fitness Trade Journal, pp. 44-47 (date unknown).
Johnny G Spinning© Instructor Manual, (Copyright 1995).
Keiser® Power Pacer, Instructor Training Manual©, by Keiser Corporation (1997, 1998).
"MG-32 Ski Machine" and "MG-034 Simple Body Stretcher", Modas Shing Co., Ltd., 1 page (undated).
*Maximize Your Performance,* "the ultimate workout" Versatrainer by Pro-Max, 1 page (undated).
Nautilus catalog, 92 pages (undated).
Nautilus® Fitness Accessories 2001 brochure, 15 pages (2001).
Nautilus® Free Weight Equipment 2001 brochure, 11 pages (2001).
Nautilus® Home Gyms 2001 brochure, 11 pages (2001).
"Nautilus Next Generation Product Line", Nautilus catalog, 8 pages, (undated).
Nautilus, The Next Generation catalog, 48 pages (undated).
Nautilus NS-4000 picture, one page (undated).
Nautilus Super Smooth Technology, "Equipment Comparison", undated brochure, one page (undated).
"Nautilus Time Machine," Nautilus Inc., cover page of product brochure and one page therefrom, 2 pages (undated).
New Fitness Trend Guarantees Company's Success, Press Release, The STEP® Company (undated).
"Odyssey 5" Home Gym, TuffStuff, cover page of product brochure and three images therefrom, 2 pages (2001).
PowerLine by TuffStuff, Task Industries Inc., PL-221, Leg Curl/Extension Combo, undated brochure.
Schwinn Cycling & Fitness Inc.,"Airdyne® Backdraft™Recumbent Bike"(1996).
Schwinn Cycling & Fitness Inc., "Airdyne®Windsprint™Interval Bike," (1996).
Schwinn®Fitness, "Harness the Force of Nature and You Possess the Strength of Confidence" brochure 30 pages (1996-1997).
Schwinn Iron Classic Strength Training System by Bowflex®Owner's Manual, 55 pages (1993).
The Slide Home Trainer, "The Professional, Portable Home Slide," brochure, The Step Company (1995).
The Slide Trainer The Professional Slideboard, "The Professional Slideboard," brochure, The Step Company (1995).
Soloflex catalog, p. 23 (1981).
"Stamina LT-2000 Band Flex Gym", Stamina Products, Inc., located at Egghead.com, 3 pages (at least as early as Mar. 9, 2001).
"The Standing Firm System", located at http://www.standing-pilates.com, 6 pages (retrieved Sep. 29, 2004).
The STEP®Company Club Price List, Les Mills International/The Step Company (May 1998).
The Step®Home Trainer, "The Intermediate Home Step System," brochure, The Step Company (1995).
The Step®Home Workout System, "The Compact Professional Step Trainer," brochure, The Step Company (1995).
The Step, "The Original Health Club Step," brochure, The Step Company (1995).
The Step, "The Professional Club Model," brochure, The Step Company (1995).
The Studio Step, "The Compact Club Model," brochure, The Step Company (1995).
Universal 1981-82 catalog, p. 12 (Jun. 1, 1981).
"V5 Multi Gym," Hoist Fitness Systems, Inc., located at http://www.hoistfitness.com, 3 pages (retrieved Apr. 30, 2004).
Little, John, Chest Essentials, Muscle & Fitness, pp. 138-144 (Sep. 1995).
Tuff Stuff Catalog, p. 3, (received by the USPTO Mar. 1998).

* cited by examiner

EXERCISE EQUIPMENT WITH MULTI-POSITIONING HANDLES

CROSS REFERENCE TO RELATED APPLICATIONS

This application is a non-provisional application based on U.S. Provisional Patent Application Ser. No. 60/201,621, filed May 3, 2000, entitled "Exercise Equipment With Floating Wrist Structure And A Back Extension Invention," the contents of which are hereby incorporated by reference in its entirety.

FIELD OF THE INVENTION

This invention relates to the field of exercise equipment, and particularly to the field of load-bearing exercise equipment. More particularly, this invention relates to the field of handle assemblies for use with the load-bearing exercise equipment.

BACKGROUND

Current exercise equipment typically has rigid handles in a fixed position for actuating a load on the exercise machine. These handles are generally required to be in a fixed position to provide stable actuation of the load on the exercise machine. Unfortunately, these handles limit the range of motion of the user's hand and wrist during the use of the equipment. This limitation of the movement of the hand and wrist throughout the range of motion of the particular exercise machine can cause unnatural strain on the user's body. Generally this strain is caused by the user's hand being forced into a position that is not a natural position. The unnatural strain exerted on the user's body, coupled with the load of the exercise machine exaggerating the strain, and the unnatural position of the user's hand, often results in a substantial amount of discomfort for the user, or even worse, injury to the user.

It would be desirable to provide a rigid handle that allows for natural hand and wrist movement throughout the range of motion of an exercise machine. The present invention provides such a handle assembly which until now has not been known in the art.

SUMMARY OF THE INVENTION

The present invention provides for an exercise device having a load wherein the primary movement is a pulling motion. The exercise device has an arm for actuating the load and a handle assembly attached to the arm for grasping by the user to actuate the load. The arm is attached to a load by any known means, such as a cable and pulley system, as is well-known in the art. The handle assembly is rotatable with respect to the arm around an axis of rotation, and is pivotable in at least two directions orthogonal to the axis rotation. The structure attaching the handle to the end of the arm in this floating manner allows the handle to move to a variety of locations during use. The floating handle structure allows the handle to be rotated about the axis of rotation and bent away from the axis of rotation by at least two orthogonally positioned pivot points. This provides a free range of motion for the hand and wrist during the exercise motion.

The present invention also provides for an exercise device having a load wherein the primary movement is a pushing motion. The exercise device has an arm for actuating the load and a handle assembly attached to the arm for grasping by the user to actuate the load. As above, the arm is attached to a load by any known means, such as a cable and pulley system, as is well-known in the art. The handle assembly is rotatable with respect to the arm about an axis of rotation, and the handle grip is actually rotatable in the user's grasp relative to the handle frame. The handle assembly in the exercise device having a load wherein the primary movement is a pushing motion is limited to rotation because any additional motion allowed is not practical when using handles to push a load.

In the figures of this application, an XYZ coordinating system may be shown as an aid to understanding the rotation of the handle assembly according to the present invention.

DETAILED DESCRIPTION OF PREFERRED EMBODIMENTS

Figure 1A:
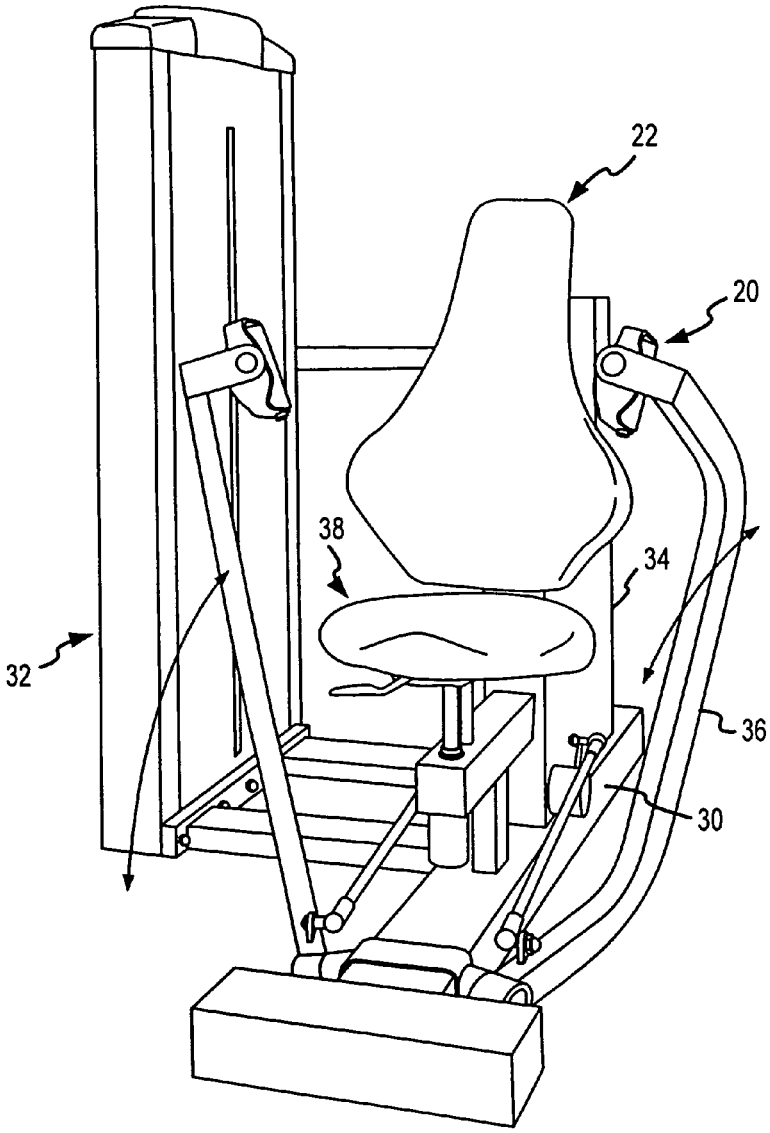
FIG. 1A shows an exercise machine allowing the user to do a seated bench press wherein the primary movement is a pushing motion.

The present invention is directed to exercise equipment having a handle assembly which provides for natural movement of the hand and wrist throughout the range of motion occurring during the use of the exercise machine. The handle assembly provides for this natural movement while maintaining the structural rigidity required for use on the exercise machine. The handle assembly 20 of the present invention is applicable to an exercise machine wherein the primary movement is a pushing movement, such as a seated bench press 22 or a seated shoulder press machine 24 (see FIGS. 1*a* and 1*b*, respectively); a machine wherein the primary movement is a pulling movement, such as a lateral pull down machine 26 or a seated row machine 28 (see FIGS. 2*a* and 2*b*, respectively); or any other machine which utilizes a weight stack or other load and a load transfer system, such as a cable and pulley mechanism. With respect to an exercise machine wherein the primary movement is a pulling movement, the handle assembly 20 preferably rotates about a rotation axis and pivots in at least two directions orthogonal to the rotation axis. With respect to an exercise machine wherein the primary movement is a pushing movement, the handle assembly 20 preferably only rotates about a rotational axis. Preferred embodiments for the handle assembly will be discussed in more detail below.

FIGS. 1*a*, 1*b*, 2*a*, and 2*b* show examples of exercise machines utilizing the handle 20 of the present invention. In common, the exercise machines each have a base 30, a weight stack or load 32, a mechanism support 34, at least one arm assembly 36 and at least one handle assembly 20 attached to the arm assembly 36. The common elements are numbered similarly between the machines. The mechanism support 34 is attached to the base 30 and includes an adjustable seat 38. The load 32 is operably connected to the arm assembly 36 which is in turn operably connected to the handle assembly 20. The operable connections are such that when the user grasps the handle assembly 30 and exerts a force in the proper direction, the load 32 is actuated. The load 32 is preferably a stack of weights slidably mounted on at least one vertical rail. The load 32 is preferably configured to allow for varying number of weights to be selected by the user such as by pin selection, as is know in the art. The operable connection between the load 32 and the arm assembly 36 is preferably a cable and pulley system designed to connect the arm 36 to the load 32 such that when the arm 36 is moved the load 32 is actuated. The operable connection between the handle assembly 20 and the arm assembly 36 will be discussed in more detail below.

Figure 1B:
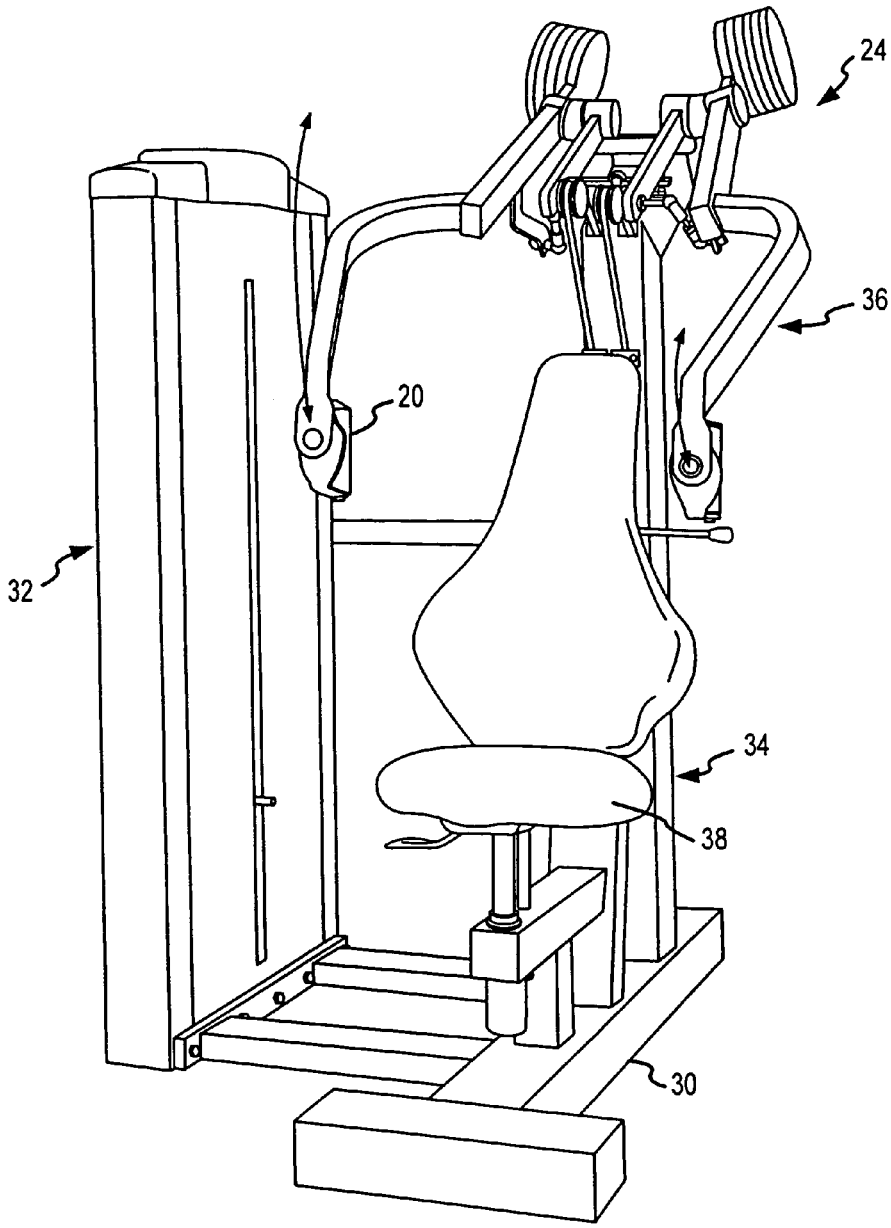
FIG. 1B shows an exercise machine allowing the user to do a seated military press wherein the primary movement is a pushing motion.
Figure 2A:
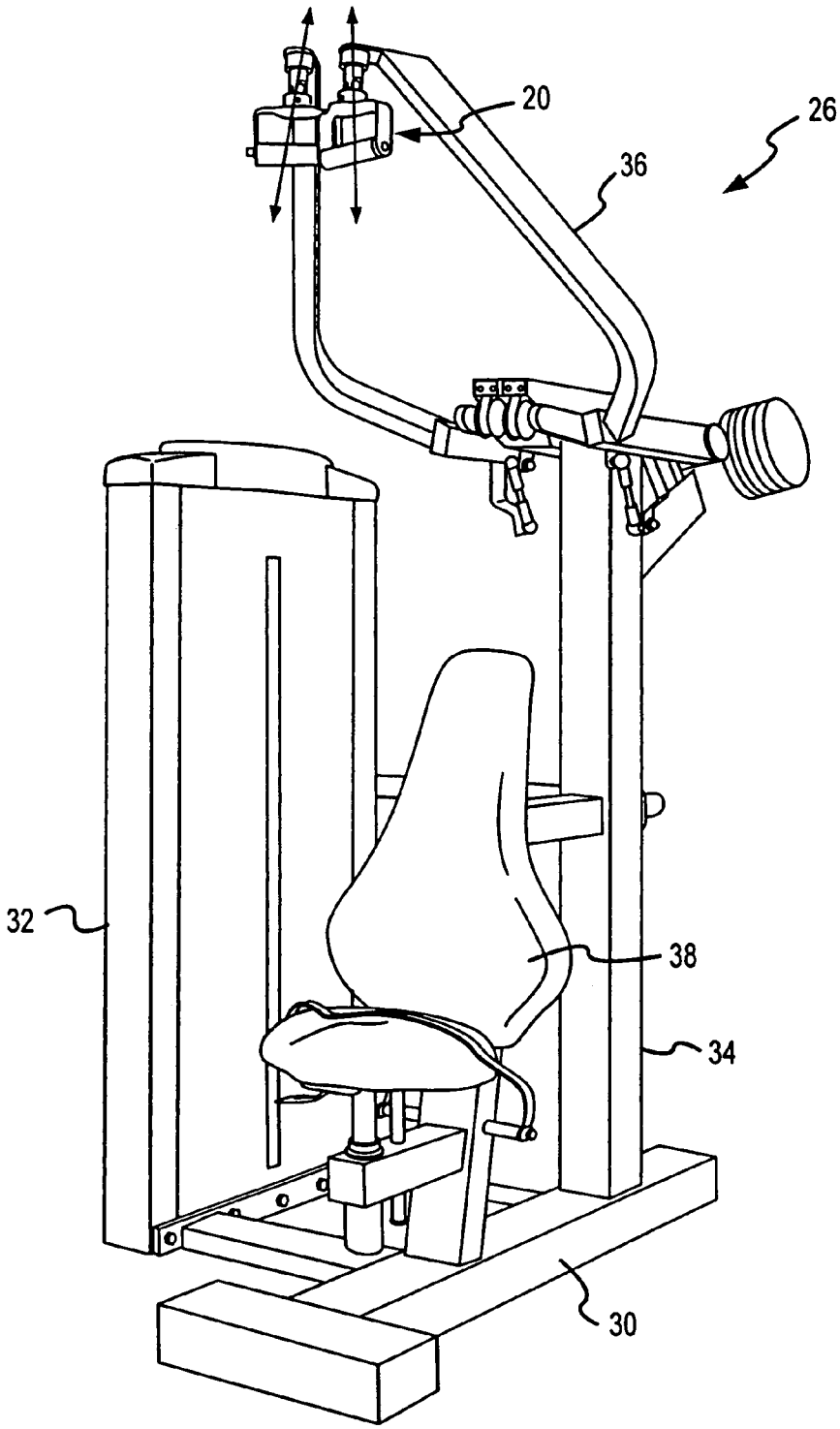
FIG. 2A shows an exercise machine allowing the user to perform a seated lat pull down motion exercise, wherein the primary movement is a pulling motion.
Figure 2B:
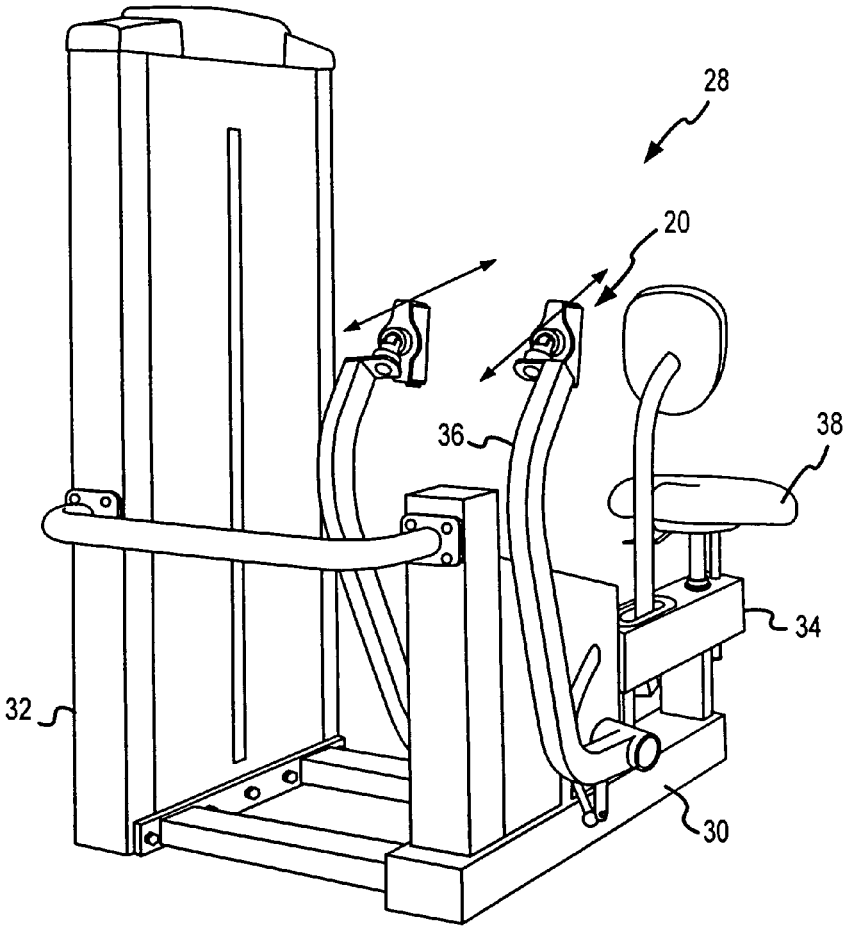
FIG. 2B shows an exercise machine allowing the user to perform a seated row, wherein the primary movement is a pulling motion.

FIG. 1*a* shows a seated bench press machine 22 with the handles 20 moving in the direction shown by the arrows. FIG. 1*b* is a seated military or shoulder press machine 24 with the handles 20 actuating the arms 36 in the manner shown by the arrows. FIG. 2*a* shows a seated lat pull down 26 wherein the arms 36 are moved by the handles 20 as shown in the direction of the arrows. FIG. 2*b* is a seated row exercise machine 28 with the arms 36 moved by the handles 20 in the direction shown by the arrows.

Figure 3:
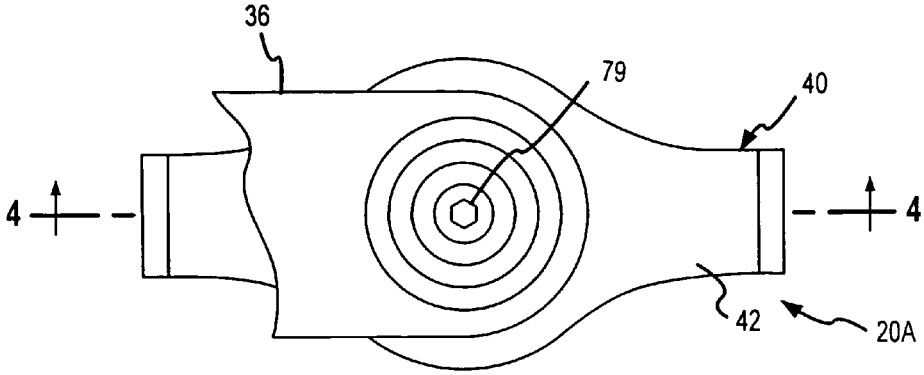
FIG. 3 is a end view of the present invention wherein the handle extends to either side of a portion of the arm to which it is attached.
Figure 4:
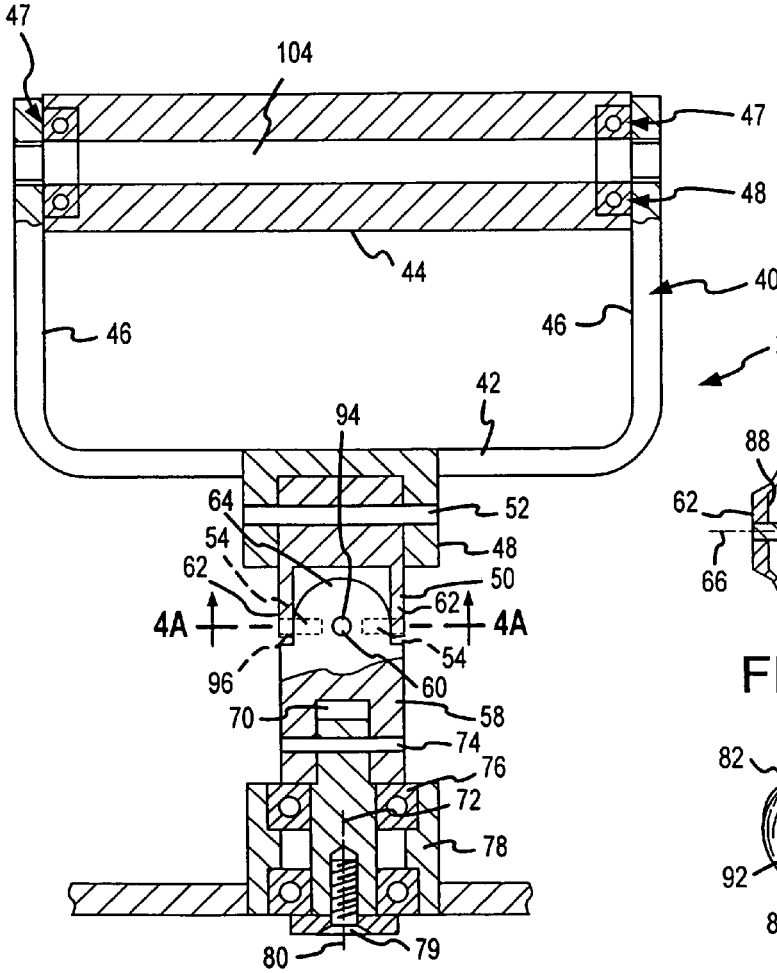
FIG. 4 is a section view taken along line 4—4 of FIG. 3 showing the articulating and rotating link structure extending between the handle and the arm portion of the exercise machine that allows movement of the handle in three dimensions, as well as rotation for use on an exercise machine where the primary movement is a pulling motion.
Figure 5:
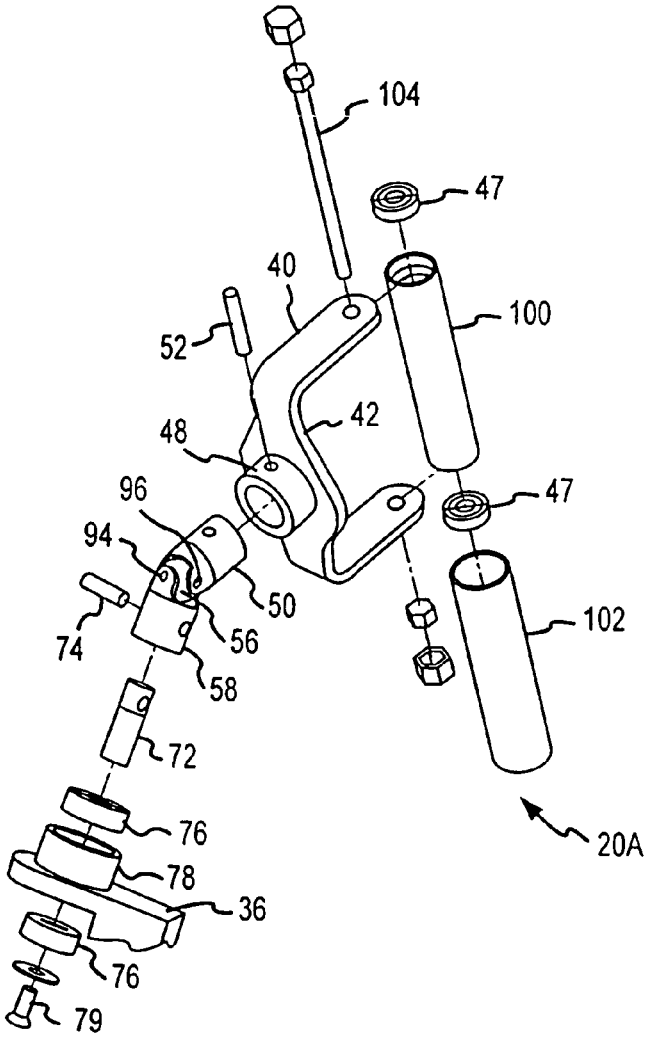
FIG. 5 is an exploded view of the articulating and rotating handle shown in FIG. 4.
Figure 5A:
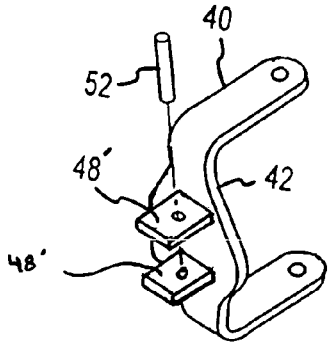
FIG. 5A is a drawing of a handle bracket including flanges.

FIGS. 3, 4, and 5 show the structure of the articulating and rotating handle assembly 20A in accordance with one embodiment of the present invention. This embodiment is preferably used with an exercise machine wherein the primary movement is a pulling movement, such as for those exercises performed on the machine shown in FIGS. 2*a* and 2*b*. Referring first to FIG. 4, the handle assembly includes a handle bracket 40 having a base member 42. The bracket 40 is preferably U-shaped, with a grasping portion 44 rotatably mounted between the legs 46 of the U-shaped bracket. The grasping portion 44 is attached to the opposing legs 46 of the U-shaped bracket 40 by a bearing structure 48 at each end of the grasping member 44. The grasping member 44 can be cylindrical in shape, or can have a contoured shape to receive a person's hands and fingers for comfortable gripping and load bearing. The base member 42 of the U-shaped bracket 40 defines a collar 48 having a recess for receiving a first axle 50. The first axle 50 is attached in the recess by a through pin 52. The through pin 52 extends approximately parallel with the bottom portion 42 of the U-shaped bracket 40, however, any known means for attaching the axle 50 with respect to the collar would likely be acceptable. As shown in FIG. 5A, this recess can also take the form of a pair of flanges 48', and the through pin 52 could form a pivot axis to actually allow the handle to pivot about the pivot connection formed between the flanges 48' and the axle 50.

The first axle 50 is in turn pivotally attached by a second pin 54 to a pivot ball 56. The second pin 54 preferably extends parallel to the first pin, but can extend in the angular orientation as desired. The pin 54 defines a pivot axis about which the handle rotates with respect to the ball 56. The pivot ball 56 is in turn attached to a second axle 58 by a pivot pin 60, the second pivot pin 60 defining a second pivot axis about which the ball pivots 56 with respect to the second axle 58. The end of the first axle 50 attached to the pivot ball 56 defines a pair of opposing flanges 62 that surround the sides of the pivot ball 56. The end of the second axle 58 that is attached to the pivot ball 56 also defines a pair of opposing flanges 64 used in conjunction with the pivot pin 60 to attach to the pivot ball 56. The pivot pins 54, 60 attaching the flanges of the first axle 50 and the second axle 58 to the pivot ball 56 can be continuous pivot pins extending through the pivot ball 56, or can be separate pivot pins positioned through each of the flanges and partially extending into the pivot ball 56 yet still forming a pivot axis for the respective set of flanges.

The pivot axis formed by the pivot pin 54 attaching the first axle 50 to the pivot ball 56 is the first pivot axis 66. See FIG. 4A. The pivot axis defined by the pin 60 attaching the flanges 64 on the second axle 58 to the pivot ball 56 define the second pivot axis 68. The first 66 and second 68 pivot axes are positioned orthogonally with respect to one another in their attachment to the pivot ball 56. See FIG. 4A. The first pivot axis 66, with respect to FIG. 4, allows the handle bracket 40 to pivot about the first pivot axis 66 into and out of the plane of the page showing FIG. 4. In that instance, the flanges 62 on the first axle 50 pivot with respect to the pivot ball 56. The second pivot axis 68 formed between the flanges 64 on the second axle 58 formed by the connection of the flanges 64 of the second axle 58 and the pivot ball 56 allow the handle bracket 40 to pivot left and right about the second pivot axis 68 with respect to the orientation of FIG. 4. In this instance, the pivot ball 56 moves with respect to the flanges 64 of the second axle 58. The second end of the second axle 58 defines a recess 70 which receives an end of the third axle 72. The end of the third axle 72 is held within the recess 70 in the second end of the second axle 58 by a pin 74 extending therethrough. A third axle 72 is mounted to the arm 36 of the exercise machine in a rotatable manner by two bearings 76 positioned inside of a sleeve 78, through which the third axle 72 extends. The third axle 72 is held in position by a fastener 79 extending from the opposite side of the exercise arm 36 into the opposite end of the third axle 72.

Through the rotational attachment of the third axle 72 to the exercise arm 36, the first pivot axis 66 and the second pivot axis 68, the handle 20A is allowed to articulate with respect to the exercise arm about two pivot axes 66, 68 orthogonally aligned to one another, and also rotate with respect to the exercise arm 36 about a longitudinal axis 80 directed along the length of the interconnected structure extending from the exercise arm 36 to the handle bracket 42. This structure allows for extreme flexibility in handle position when coupled to an exercise device.

For instance, if the arm of the exercise machine moves in two or three dimensions through the stroke of the exercise machine, the handle 20A as described above, allows the user to naturally position their hands and wrists to best orient their hands and wrists during the exercise. The pins 52 and 74, respectively, attaching the first axle to the collar 48 on the handle as well as the third axle 72 to the end of the second axle 58, given the correct structural modifications, can also each act as additional pivot axes to provide four total pivot axes and one rotational axis. In addition, the hand grip 44 rotates with respect to the handle bracket 42 to provide yet another degree of freedom in allowing the user to automatically adjust the grip during the pulling exercise.

Figure 4A:
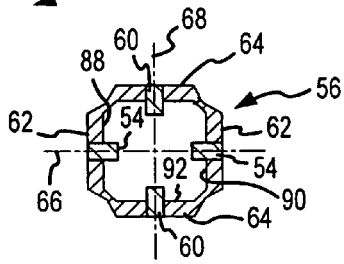
FIG. 4A is a section view taken along line 4A—4A of FIG. 4.
Figure 4B:
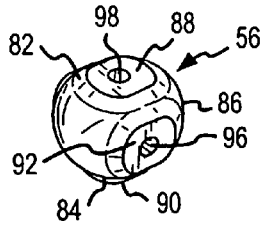
FIG. 4B is an isometric view of a ball pivot for use in one embodiment of the present invention.

Referring to FIG. 4*b*, the pivot ball 56 is formed of a short cylinder having beveled top 82 and bottom 84 edges transitioning from the cylindrical wall 86 to the flat top 88 and bottom 90 surfaces. Two flat spots 92 are formed in diametrically opposing positions along the outer curved sidewalls of the cylinder along the entire length of the cylinder. As shown in FIG. 4A, one set of flanges 62 engages the flat top 88 and bottom 90 of the cylinder and the other set of flanges 64 engages the flat sidewalls 92 of the cylinder.

FIG. 5 is an exploded view of the articulating and rotating handle 20A embodiment of the present invention. The handle 20A is attached in an articulating and rotating relationship with the exercise handle as described above. The exercise handle 20A defines a collar 78 into which is positioned two bearing structures 76, such as ball bearings. The ball bearing structures receive an end of the third axle 72 which is attached to the exercise arm 36 and inside the collar by a fastener 79. The first end of the third axle 72 inserts into a recess 70 formed in the second end of the second axle 58 as held therein by a press fit pin 74. The first end of the second axle 58 is attached to the pivot ball 56. Two flanges 64 are formed at first end of the second axle 58 to surround the pivot ball 56. Each flange 64 defines an aperture 94 which is aligned with a corresponding aperture 96 formed in the pivot ball 56 to receive a pivot pin 60, or pins depending on the design, which forms the second pivot axis 68. The pivot ball 56 is attached to the second end of the first axle 50 in a similar manner. The second end of the first axle 50 defines two opposing flanges 62 which also define apertures 96 (in dash). These apertures 96 are positioned in alignment with apertures 98 formed in the pivot ball 56 and a pin 54 or pins are positioned through the apertures 96 in the flanges 62 on the second end of the first axle 50 to attach to the pivot ball 56 to form the first pivot axis 66. The first 66 and second 68 pivot axis are offset by 90° from one another. The first end of the first axle 50 is received within a recess formed by a collar 48 on the bottom 42 of the handle bracket 40. The first end of the first axle 50 is attached or secured within the collar 48 by a press fit pin 52. The grip handle 44 has an inner cylinder 100 and an outer cylinder 102, the outer cylinder 102 being made of a cushioning material and the inner cylinder 100 being made of a strong material. Either end of the gripping member 44 is fit over a bearing 47 through which is positioned a bolt 104 to hold the gripping 44 member to the handle bracket 40 in a rotating relationship.

Figure 6:
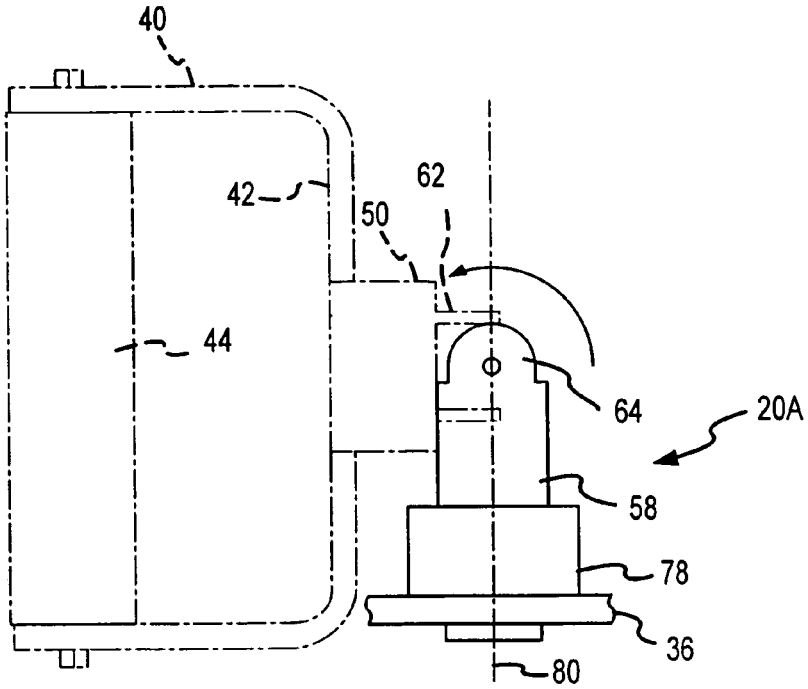
FIG. 6 is a drawing of handle of the present invention of the articulating and rotating handle of the present invention bent orthogonally to the left with respect to the axis of rotation.
Figure 7:
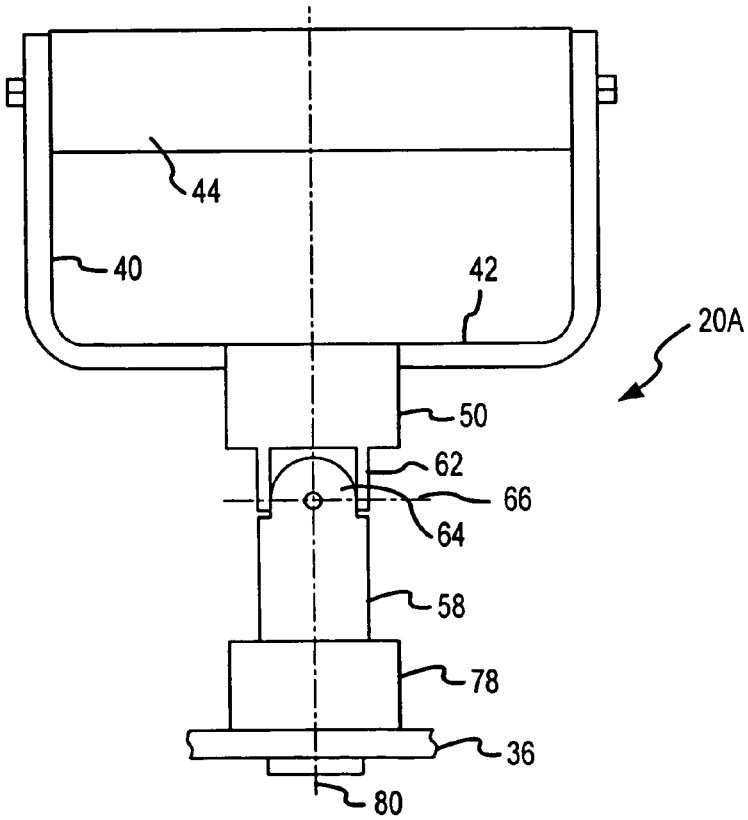
FIG. 7 shows the articulating and rotating handle in the position with the handle extended in line with the axis of rotation.
Figure 8:
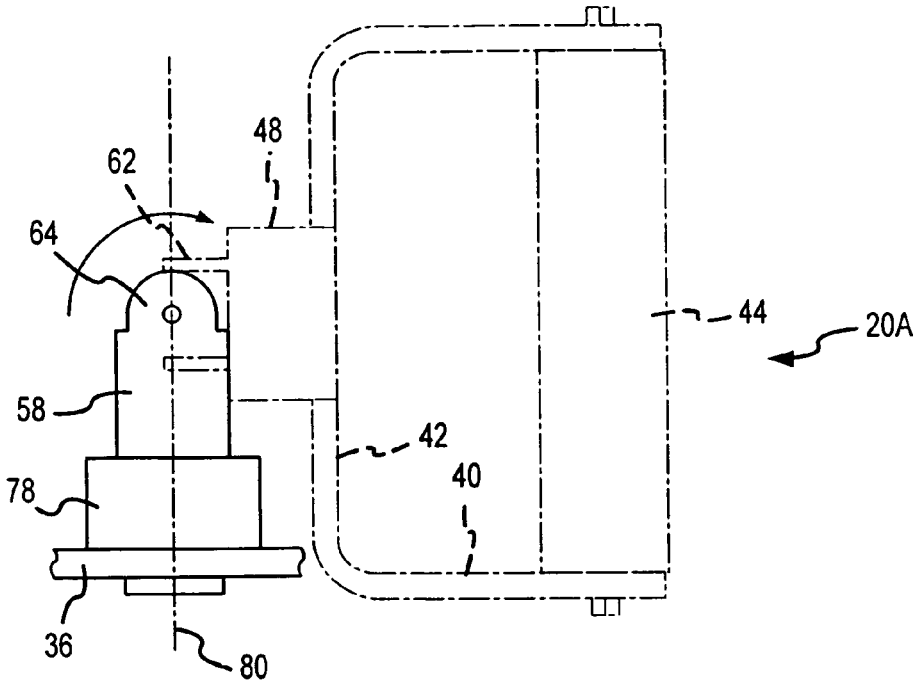
FIG. 8 shows the articulating and rotating handle of the present invention bent at a 90° angle to the right with respect to the axis of rotation.

FIGS. 6, 7, and 8 show the relative motion of the handle 20A with respect to the attachment structure given its construction. FIG. 6 shows the pivot ball 56 and the first axle 50 pivoting around the second axis 68 to a position offset 90° from the axis of rotation 80. The handle 40 can pivot about the second axis 68 to the mirror image shown in FIG. 6 so that the handle bracket 40 extends to the right in this configuration. This is shown in FIG. 8. FIG. 7 shows the handle in a vertical alignment with the pivoting structure and the axis of rotation 80. With respect to FIG. 7, the handle 40 can pivot into and out of the page around the first pivot axis 66 and therefore moves with respect to the second axle 58 and pivot ball 56.

Figure 9:
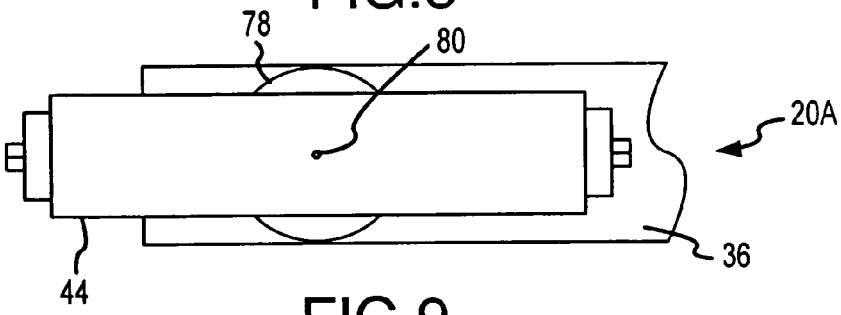
FIG. 9 is an end view of the handle of the articulating and rotating handle with the hand grip extending in line with the arm member of the exercise machine.
Figure 10:
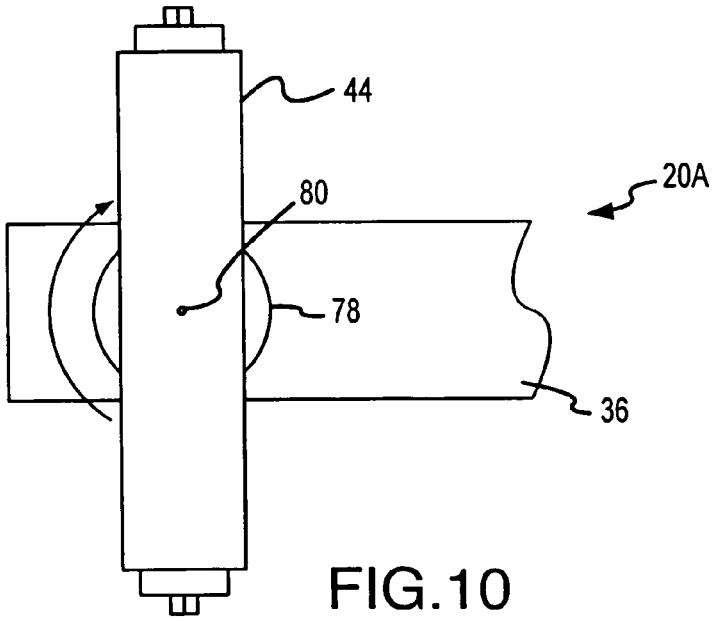
FIG. 10 is an end view of the articulating and rotating handle of FIG. 9 with the handle having been rotated 90° from the position shown in FIG. 9.

FIG. 9 is an end view of the handle 40 with the gripping member 44 in alignment with the exercise arm 36. The rotational mounting of the third axle 72 to the exercise arm 36 allows the exercise handle 20A to rotate about the axis of rotation 80 by 360°.

The combination of the articulating and rotating motions shown in FIGS. 6, 7, 8, 9, and 10 provide an extremely versatile and motion of the handle 20A to allow the user in a pulling exercise to align their hands and wrists as desired with respect to the load. This applies for both the pulling motion and the reverse extending motion. This type of motion is found in exercise machines such as those shown in FIGS. 2*a* and 2*b*.

Figure 11:
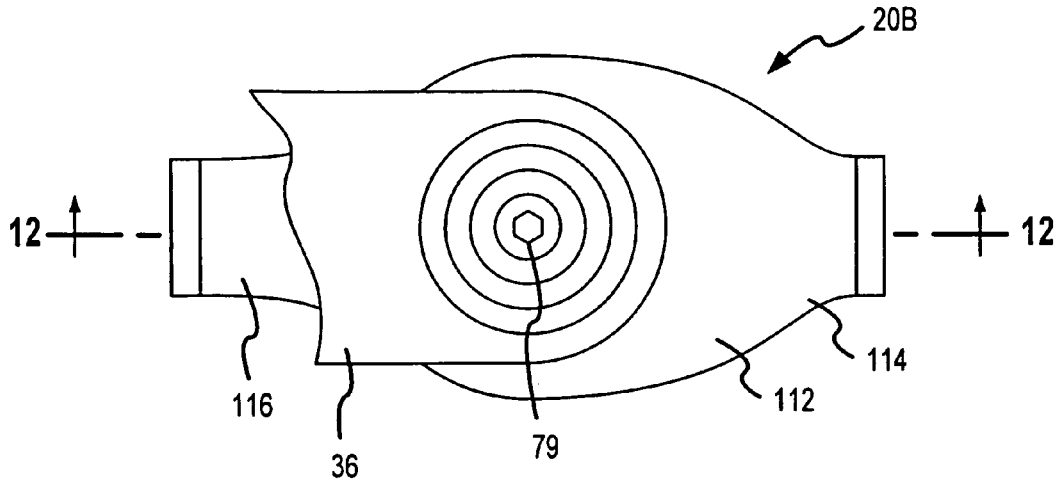
FIG. 11 is a side view of another embodiment of the handle showing the side members of the bracket where one portion of the side member of the bracket is significantly larger than the other portion of the side member of the bracket.
Figure 12:
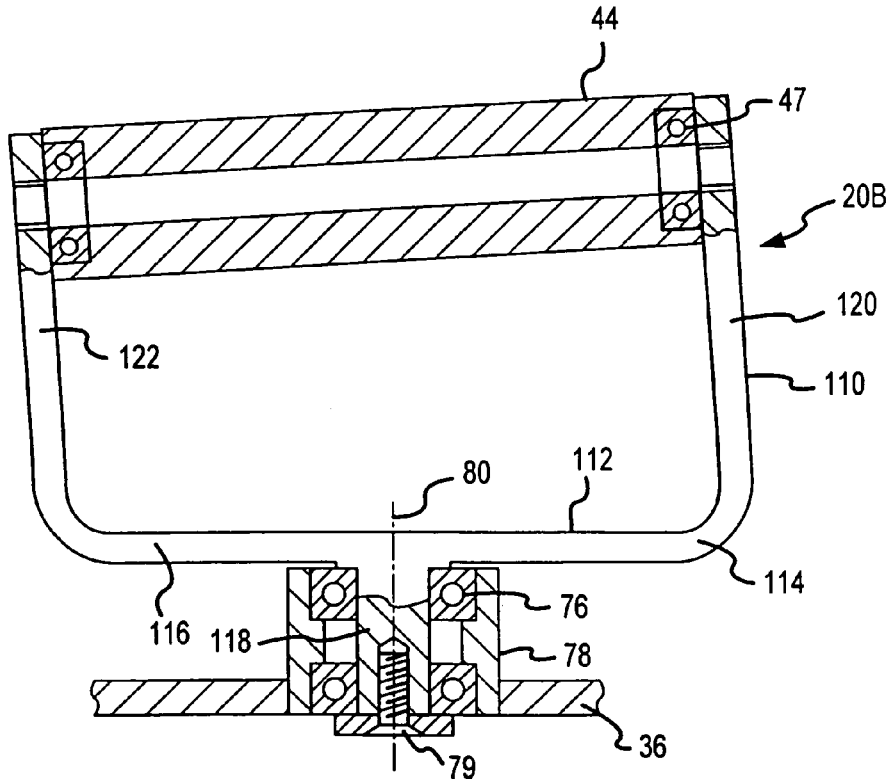
FIG. 12 is a section taken along line 12—12 of FIG. 1, and shows the rotational structure attaching the handle to the exercise arm, and also shows the rotating structure attaching the hand grip portion to the handle bracket.
Figure 13:
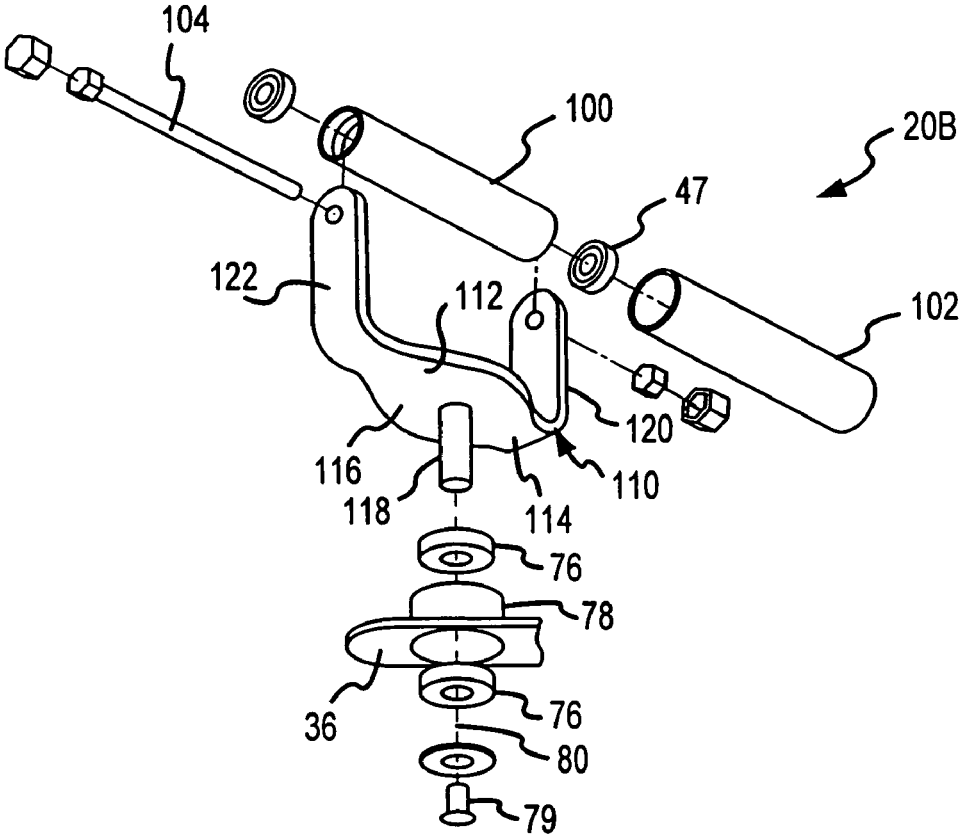
FIG. 13 is an exploded view of the embodiment of the handle shown in FIG. 12.

FIGS. 11, 12, and 13 show an embodiment of the handle 20B used on exercise machines where the primary motion is one of pushing as opposed to pulling. The elements similar to those on handle 20A are similarly labeled. These types of machines are shown in FIGS. 1*a* and 1*b*. Because the handles 20B are used for pushing, the articulation of the handle with respect to the exercise arm 36 is eliminated and the rotation of the handle with respect to the exercise arm 36 remains to allow for some adjustment of the user's hands with respect to the exercise arm 36 during the stroke of the exercise. FIG. 11 shows the handle bracket 110 attached to an end of the exercise arm 36 in a rotational relationship. The base 112 of the handle bracket 110 has an asymmetrical shape about the axis of rotation 80 such that one side 114 is wider and thus heavier than the other side 116. The wider and heavier side 114 causes the handle 20B to pivot to a particular upright position with the heavier side 114 pointing downwardly when the exercise arm 36 is positioned in a relatively vertical plane such as that shown in FIGS. 1*a* and 1*b*. Note that in FIGS. 1*a* and 1*b* the wider and heavier portion 114 of the handle bracket 110 is pointed downwardly. This is to orient the handles in a fixed manner for the user as the user enters the machine and prepares for the exercise.

FIG. 12 shows a cross-section of the handle 20B of this embodiment and the rotational connection of the axle 118 extending from the base of the handle bracket 110 with the exercise arm 36. The handle bracket 110 is generally U-shaped, however the legs 120, 122 of the handle bracket are angled both to one side relative to the base 112, with one leg 120 being longer than the other leg 122, to provide an angle of the gripping member 44 with respect to the base 112 of the handle bracket 110, and also with respect to the exercise arm 36. The longer of the two legs 120 of the handle bracket 110 is on the end having the heavier and wider portion so that when the exercise arm is at rest in a relatively vertical orientation, the gripping member 44 is angled upwardly and away from the user when the user is sitting in the exercise machine. In this embodiment, the hand grip portion 44 is rotatably mounted between the legs 122, 120 of handle bracket as is disclosed above. This angled handle can also be used with an articulating handle for exercise equipment having a pulling motion such as those shown in FIG. 2*a* and 2*b*.

FIG. 13 is an exploded view of the handle 20B of this embodiment and shows the bearing 76 fitting into a collar 78 formed in the end of the exercise arm 36. The post 118 extending from the base 112 of the handle bracket 110 extends through the bearings 76 and into the collar 78 and is held in place by a fastener 79 extending into the end of the post 118. The hand grip 44 is rotatably mounted between the extending arms 120, 122 of the handle bracket 110 as described above. In use, the handle 20B can rotate along the rotational axis 80 defined by the post 118 extending from the bottom 112 of the handle bracket 110 to allow the user to adjust the rotational angle of the handle bracket 110 of the handle with respect to the exercise arm 36 about the rotational axis 80 formed by the post 118.

The handle assemblies 20A, 20B discussed above are preferably constructed of metal such as carbon, steel or stainless steel, or can be made of hard impact resistant plastic for durability. The bearings are preferably metal ball bearings but these joints can be created by any other complex universal joint that would allow for rotation about an axis of rotation.

In operation, for example, in using the exercise machine 28 as shown in FIG. 2*b*, the user sits on the seat and rests against the front support. The weight desired for the exercise motion is selected at the stack 32. The user grasps a handle 20A in each hand and pulls the exercise arms 36 towards the user's chest, either individually or together as desired. With respect to the machine 28 shown in FIG. 2*b* the user can grasp a handle assembly 20A with the palm faced down and as the handle is moved toward the user, the hand can be rotated inwardly to a palm face up position. This allows the user to flex their wrists through a full 180° during the course of the exercise stroke. The floating handle assembly 20A thus allows the hand to be positioned as is natural for the user and does not force any one particular hand orientation. In addition, the hand does not have to be rotated during the exercise, or the hand can be rotated oppositely from that described.

The user's hands can be similarly rotated during the exercise stroke for the machines that require primarily pushing motion. Additionally, for the machines requiring primarily a pulling motion, the hands cannot only be rotated, but the hands can be moved inwardly, outwardly, or any direction with respect to the rotation axis as desired by the user due to the articulating structure described above.

While the invention has been particularly shown and described with reference to preferred embodiments thereof, it will be understood by those skilled in the art that various other changes in structure or form and detail may be made without departing from the spirit and scope of the invention. Presently preferred embodiments of the present invention and many of its improvements have been described with a degree of particularity. It should be understood that this description has been made by way of example, and that the invention as defined by the scope of the following claims.

What is claimed is:

1. An exercise machine having a load wherein the primary movement is a pushing motion to actuate the load comprising:

at least one arm assembly operably attached to said load;

a handle base member including a first leg and a second leg extending from a base portion, said base portion rotatably attached to said arm assembly between said first leg and said second leg, and rotating with respect to said arm assembly about a first axis of rotation at a midpoint of said base portion;

a grasping member rotatably connected with said first leg and said second leg, said grasping member rotating with respect to said handle base member about a second axis of rotation; and wherein said handle base member further comprises an asymmetrical shape about said first axis of rotation such that when not in use said handle base member rotates to an upright position.

2. The exercise machine of claim 1, wherein said first axis of rotation is not orthogonal to said second axis of rotation.

3. An exercise machine handle assembly operably attached to an arm assembly of an exercise machine, said handle assembly comprising:

a handle member having a base rotatably connected to said arm assembly about a first axis of rotation, the first axis of rotation at a midpoint of said base; and said base having a first side to one side of said midpoint and a second side to another side of said midpoint, said first side being heavier than said second side such that when said exercise machine is not in use, said handle member rotates to an upright position in which said first side is below said second side.

4. An exercise device having a load comprising:

at least one arm assembly operably attached to said load;

a handle assembly comprising:

a generally U-shaped bracket defining a base member and supporting a gripping portion;

a first axle rotatably connected with the base member to rotate about a fixed axis relative to the base member and extending from the base member, said U-shaped bracket pivoting in at least one orthogonal direction with respect to said first axle;

a second axle pivotally connected with the first axle, the second axle operably attached to said arm assembly; and wherein the first axle and the second axle may be longitudinally aligned during use.

5. The exercise device of claim 4 further comprising:

a third axle rotatably connected with the at least one arm assembly; and the third axle is operably connected with the second axle.

6. The exercise device of claim 5 further comprising a sleeve having at least one bearing therein, said sleeve being attached to said third axle and said arm assembly.

7. The exercise device of claim 4 wherein:

the first axle is pivotally connected with the second axle at a ball-type pivot joint.

8. The exercise device of claim 4 wherein:

the U-shaped bracket defines a first leg and a second leg extending generally transverse from the base member;

the gripping portion is rotatably connected between the first leg and the second leg.

9. The exercise device of claim 4 wherein:

said handle assembly pivoting in at least one orthogonal direction with respect to said first axle.

10. The exercise device of claim 4 wherein the first axle pivots in at least two orthogonal directions with respect to the second axle.

11. The exercise device of claim 4 wherein the first axle extends perpendicularly from the base member.

12. An exercise device having a load comprising:

at least one arm assembly operably attached to said load;

a handle assembly comprising:

a generally U-shaped bracket defining a base member and supporting a gripping portion;

a first axle rotatably connected with the base member and extending angularly from the base member;

a second axle pivotally connected with the first axle, the second axle operably attached to said arm assembly; and a third axle rotatably connected with the at least one arm assembly and operably connected with the second axle;

a sleeve having at least one bearing therein, the sleeve being attached to the third axle and the arm assembly; and wherein the first axle and the second axle may be longitudinally aligned during use.

* * * * *